US009080539B2

(12) United States Patent
Suzaka et al.

(10) Patent No.: US 9,080,539 B2
(45) Date of Patent: Jul. 14, 2015

(54) ELECTROMAGNETIC FUEL INJECTION VALVE

(71) Applicant: KEIHIN CORPORATION, Shinjuku-ku, Tokyo (JP)

(72) Inventors: Junya Suzaka, Tochigi (JP); Keisuke Machida, Tochigi (JP); Daisuke Kondo, Tochigi (JP); Ryosuke Takenaka, Tochigi (JP)

(73) Assignee: Keihin Corporation, Tokyo (JP)

( * ) Notice: Subject to any disclaimer, the term of this patent is extended or adjusted under 35 U.S.C. 154(b) by 132 days.

(21) Appl. No.: 14/069,478

(22) Filed: Nov. 1, 2013

(65) Prior Publication Data

US 2014/0124603 A1 May 8, 2014

(30) Foreign Application Priority Data

Nov. 5, 2012 (JP) ..... 2012-243866

(51) Int. Cl.

| | |
|---|---|
| ***F02M 51/06*** | (2006.01) |
| ***F02M 61/12*** | (2006.01) |
| ***F02M 61/10*** | (2006.01) |
| ***F02M 61/14*** | (2006.01) |

(52) U.S. Cl.

CPC ..... *F02M 61/12* (2013.01); *F02M 51/0625* (2013.01); *F02M 51/0675* (2013.01); *F02M 61/10* (2013.01); *F02M 61/14* (2013.01); *F02M 2200/856* (2013.01)

(58) Field of Classification Search

CPC ..... F02M 51/0625; F02M 61/12; F02M 51/0675; F02M 61/14; F02M 61/10

USPC ..... 239/585.1–585.5, 533.11; 251/129.09, 251/129.11–129.12, 129.15, 129.21

See application file for complete search history.

(56) References Cited

U.S. PATENT DOCUMENTS

| | | | | |
|---|---|---|---|---|
| 5,110,053 | A * | 5/1992 | Stevens | 239/533.9 |
| 7,273,186 | B2 * | 9/2007 | Kubo et al. | 239/88 |
| 2008/0149744 | A1 * | 6/2008 | Mueller | 239/584 |
| 2008/0276907 | A1 | 11/2008 | Abe et al. | |
| 2011/0180635 | A1 * | 7/2011 | Spiers et al. | 239/585.3 |

FOREIGN PATENT DOCUMENTS

| | | | |
|---|---|---|---|
| EP | 1 672 213 | A1 | 6/2006 |
| EP | 2 141 350 | A1 | 1/2010 |
| JP | 2010-180785 | A | 8/2010 |

* cited by examiner

*Primary Examiner* — Len Tran
*Assistant Examiner* — Tuongminh Pham
(74) *Attorney, Agent, or Firm* — Carrier Blackman & Associates, P.C.; Joseph P. Carrier; William D. Blackman

(57) ABSTRACT

In an electromagnetic fuel injection valve which is configured to absorb an unbalanced load applied to sliding portions between a fixed core and a valve stem, thereby enabling a reduction in a frictional resistance of the sliding portions, a guide bush is press fitted in an inner peripheral surface of the fixed core, the valve element includes a valve part configured to cooperate with the valve seat, and the valve stem continuously provided to the valve part and extending toward the guide bush, a sliding member configured to be slidably fitted to an inner peripheral surface of the guide bush is press fitted on the valve stem, wherein an annular gap is provided at least at one of a location between the fixed core and the guide bush and a location between the valve stem and the sliding member, within sliding regions of the guide bush and the sliding member.

3 Claims, 3 Drawing Sheets

ELECTROMAGNETIC FUEL INJECTION VALVE

BACKGROUND OF THE INVENTION

1. Field of the Invention

The present invention relates to an improvement of an electromagnetic fuel injection valve comprising: a valve housing having a valve seat at a front end thereof; a hollow fixed core continuously provided to a rear end of the valve housing; a movable core disposed opposite to an attraction surface of the fixed core; a coil disposed on an outer periphery of the fixed core; a valve element connected to the movable core to cooperate with the valve seat; and a valve spring configured to bias the valve element in a valve closing direction, wherein the movable core is caused to be attracted to the fixed core by energizing the coil so as to open the valve element.

2. Description of the Related Art

Such an electromagnetic fuel injection valve is known as disclosed in Japanese Patent Application Laid-open No. 2010-180785.

SUMMARY OF THE INVENTION

Heretofore, in order to stabilize an opening and closing attitude of a valve element in such an electromagnetic fuel injection valve, it is known that a rear end portion of a valve stem of the valve element is extended into a hollow portion of a fixed core, and a sliding member is secured to the rear end portion and slidably supported on an inner peripheral surface of the fixed core. Meanwhile, an unbalanced load (side thrust) is applied between the sliding member and the fixed core in some cases due to manufacturing errors of each part, an attraction force in an oblique direction generated between the fixed core and a movable core, or the like. Such an application causes a high frictional resistance between the sliding member and the fixed core, bringing about inconveniences that the opening and closing response of the valve element is reduced, and that the sliding portion is worn more quickly.

The present invention has been made in view of such a circumstance. An object of the present invention is to provide the electromagnetic fuel injection valve, which is configured to absorb an unbalanced load applied to sliding portions between a fixed core and a valve stem due to manufacturing errors or the like, thereby enabling a reduction in the frictional resistance of the sliding portions.

In order to achieve the object, according to a first aspect of the present invention, there is provided an electromagnetic fuel injection valve comprising: a valve housing having a valve seat at a front end thereof; a hollow fixed core continuously provided to a rear end of the valve housing; a movable core disposed opposite to an attraction surface of the fixed core; a coil disposed on an outer periphery of the fixed core; a valve element connected to the movable core to cooperate with the valve seat; and a valve spring configured to bias the valve element in a valve closing direction, wherein the movable core is caused to be attracted to the fixed core by energizing the coil so as to open the valve element, a guide bush is press fitted in an inner peripheral surface of the fixed core, the valve element includes: a valve part configured to cooperate with the valve seat; and a valve stem continuously provided to the valve part and extending toward the guide bush, a sliding member configured to be slidably fitted to an inner peripheral surface of the guide bush is press fitted on the valve stem, wherein an annular gap is provided at least at one of a location between the fixed core and the guide bush and a location between the valve stem and the sliding member, within sliding regions of the guide bush and the sliding member.

According to the first aspect of the present invention, the annular gap is provided at least at one of the location between the fixed core and the guide bush and the location between the valve stem and the sliding member, within the sliding regions of the guide bush and the sliding member. Hence, when an unbalanced load is applied between the guide bush and the sliding member due to manufacturing errors, an attraction force in an oblique direction generated between the fixed and the movable cores, or the like, a portion of the guide bush or the sliding member corresponding to the annular gap is elastically deformed so that the unbalanced load can be absorbed. This ensures that the guide bush and the sliding member smoothly slide on each other, making it possible to enhance the opening and closing response of the valve element.

According to a second aspect of the present invention, in addition to the first aspect, the annular gap is provided at each of the location between the fixed core and the guide bush and the location between the valve stem and the sliding member, within the sliding regions of the guide bush and the sliding member.

According to the second aspect of the present invention, the annular gap is provided at each of the location between the fixed core and the guide bush and the location between the valve stem and the sliding member, within the sliding regions of the guide bush and the sliding member. Hence, when the unbalanced load is applied between the guide bush and the sliding member, portions of both the guide bush and the sliding member corresponding to the annular gaps, respectively, are elastically deformed so that the unbalanced load can be effectively absorbed. This ensures that the guide bush and the sliding member more smoothly slide on each other, making it possible to further enhance the opening and closing response of the valve element.

Furthermore, in assembling the fuel injection valve, when the guide bush is press fitted in the inner peripheral surface of the fixed core, the portion of the guide bush corresponding to the annular gap at an outer periphery of the guide bush is a non-press fitting portion. Hence, a sliding surface of the guide bush can be prevented from being deformed by a press fitting load of the guide bush to the fixed core. Meanwhile, when the sliding member is press fitted on an outer peripheral surface of the valve stem, the portion of the sliding member corresponding to the annular gap at an inner periphery of the sliding member is a non-press fitting portion. Hence, a sliding portion of the sliding member can be prevented from being deformed by a press fitting load of the sliding member to the valve stem.

According to a third aspect of the present invention, in addition to the second aspect, an outer peripheral surface of the sliding member is provided with a cutout configured to make a hollow portion of the fixed core communicate with an inside of the valve housing.

According to the third aspect of the present invention, the outer peripheral surface of the sliding member is provided with the cutout configured to make the hollow portion of the fixed core communicate with the inside of the valve housing. This enables fuel to flow from the hollow portion of the fixed core toward the valve housing through the cutout without being interfered with the sliding member.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below based on the accompanying drawings.

Figure 1:
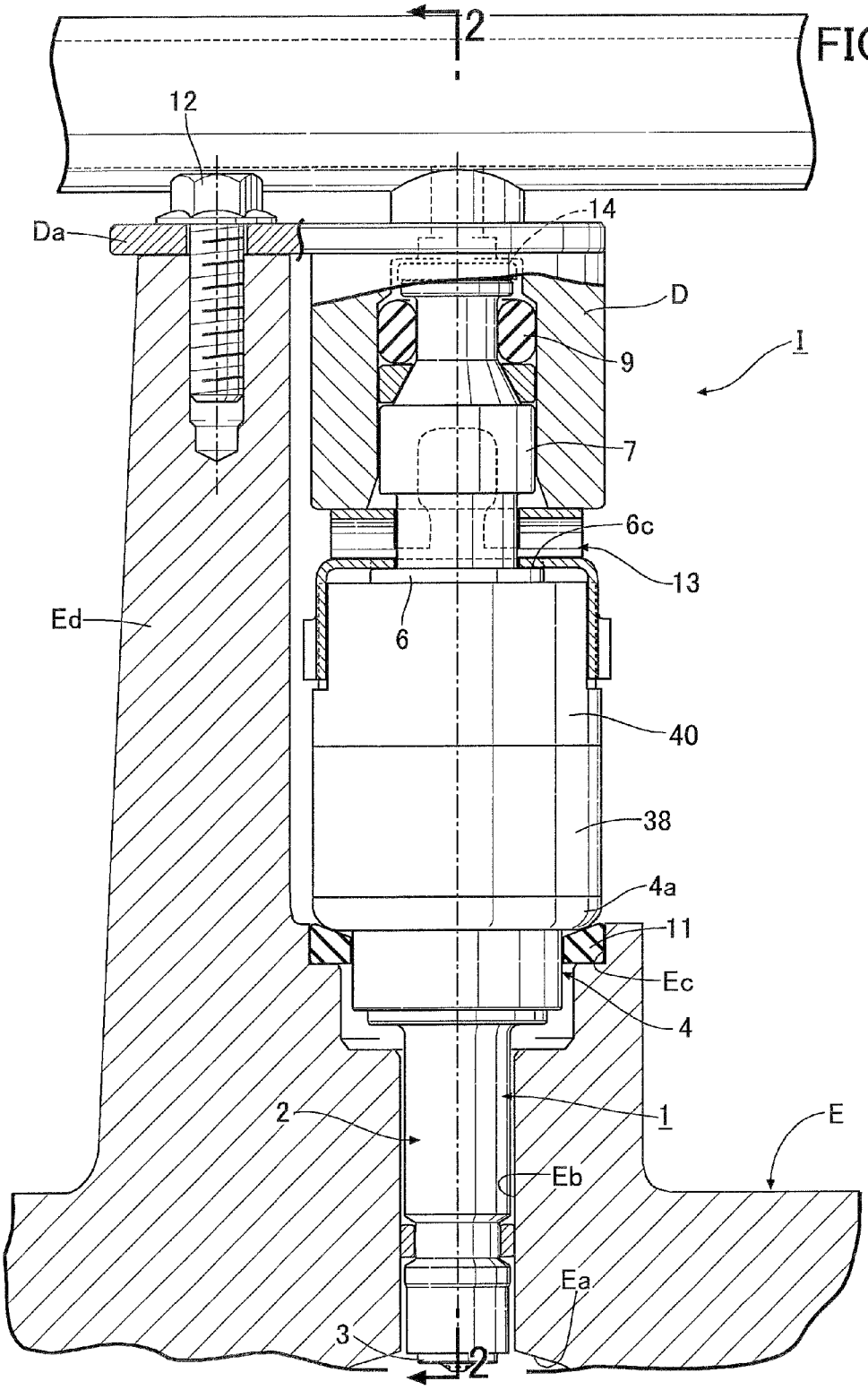
FIG. 1 is a front view showing an electromagnetic fuel injection valve according to an embodiment of the present invention, the electromagnetic fuel injection valve mounted on an engine.
Figure 2:
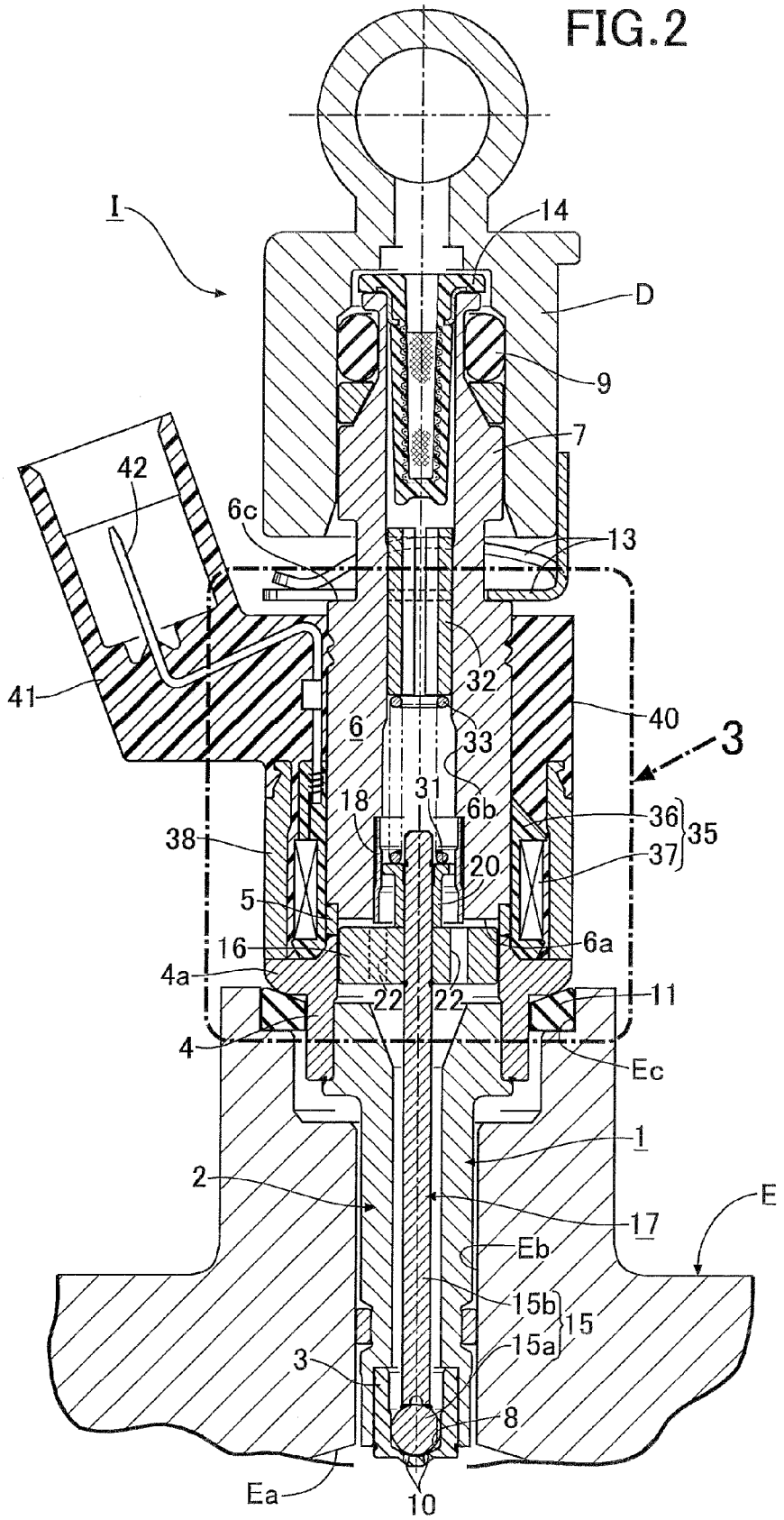
FIG. 2 is a sectional view taken along the line 2-2 in FIG. 1.

In FIGS. 1 and 2, a cylinder head E of an engine is provided with a fitting hole Eb open to a combustion chamber Ea. An electromagnetic fuel injection valve I is fitted in the fitting hole Eb. The fuel injection valve I is capable of injecting fuel toward the combustion chamber Ea. Here, in the fuel injection valve I, a fuel injection side is referred to as a front side, and a fuel inlet side is referred to as a rear side.

A valve housing 1 of the fuel injection valve I includes: a hollow cylindrical valve housing body 2; a bottomed cylindrical valve seat member 3 fitted in and welded to an inner peripheral surface at a front end portion of the valve housing body 2; a magnetic cylindrical body 4 fitted in and welded to an outer periphery of a large diameter portion 2*a* at a rear end of the valve housing body 2; and a non-magnetic cylindrical body 5 coaxially connected to a rear end of the magnetic cylindrical body 4. A fixed core 6 is coaxially connected to a rear end of the non-magnetic cylindrical body 5, and a fuel inlet tube 7 is coaxially and integrally connected to a rear end of the fixed core 6. The fixed core 6 has a hollow portion 6*b* communicating with an interior of the fuel inlet tube 7.

The magnetic cylindrical body 4 integrally has a flange-shaped yoke portion 4*a* at an intermediate portion in an axial direction of the magnetic cylindrical body 4. The yoke portion 4*a* is supported by a load receiving hole Ec via a cushion member 11, the load receiving hole Ec surrounding an upper end opening of the fitting hole Eb of the cylinder head E. Thereby, the yoke portion 4*a* constitutes a first load receiver supported by the cylinder head E in an axial direction of the fuel injection valve I.

A fuel filter 14 is fitted in an inlet of the fuel inlet tube 7. A fuel distribution pipe D configured to distribute high pressure fuel is fitted around an outer periphery of the fuel inlet tube 7 with a seal member 9 in between. An elastic holding member 13 formed of a leaf spring is set between the fuel distribution pipe D and a rear end surface 6*c* of the fixed core 6. A bracket Da of the fuel distribution pipe D is secured with a bolt 12 to a support column Ed provided to the cylinder head E in such a manner that a predetermined set load (compression load) is applied to the elastic holding member 13. Thereby, the rear end surface 6*c* of the fixed core 6 constitutes a second load receiver supported by the elastic holding member 13 in the axial direction of the fuel injection valve I. In this manner, the fuel injection valve I is held between the cylinder head E and the elastic holding member 13 under the set load of the elastic holding member 13, and thereby resists a high pressure of the combustion chamber Ea of the engine.

The valve seat member 3 is provided with a conical valve seat 8 at a front end wall thereof and multiple fuel discharge holes 10 open to the vicinity of the center of the valve seat 8.

A valve assembly 17 including a valve element 15 and a movable core 16 is housed in the valve housing 1 within a range from the valve seat member 3 to the non-magnetic cylindrical body 5. The valve element 15 includes a spherical valve part 15*a* configured to open and close the fuel discharge holes 10 in cooperation with the valve seat 8, and a valve stem 15*b* configured to support the valve part 15*a* and extending to the hollow portion 6*b* of the fixed core 6. The valve part 15*a* is formed into a spherical shape so that the valve part 15*a* can be slidably supported on an inner peripheral surface of the valve seat member 3. An outer peripheral surface of the valve part 15*a* is provided with multiple flat portions allowing fuel to flow.

Figure 3:
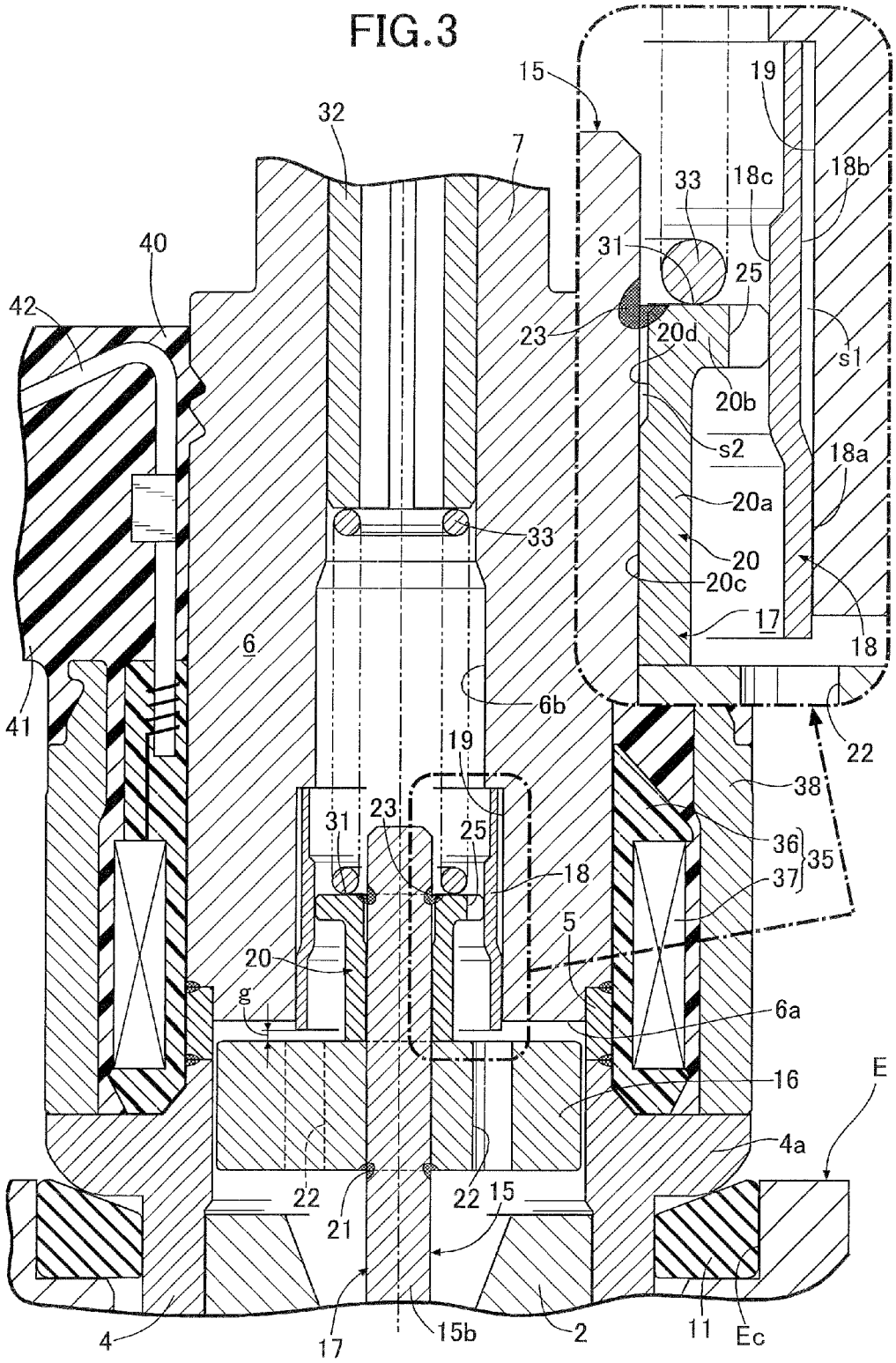
FIG. 3 is an enlarged view of the portion 3 in FIG. 2.

As shown in FIG. 3, a fitting recess 19 open to an attraction surface 6*a* at a front end of the fixed core 6 is formed on an inner peripheral surface of the fixed core 6. A cylindrical guide bush 18 is press fitted in the fitting recess 19. In this process, the guide bush 18 is disposed in such a manner that a front end portion thereof slightly projects from a front end surface, that is, the attraction surface 6*a*, of the fixed core 6.

A press fitting portion 18*a* and a non-press fitting portion 18*b* having a smaller diameter than the press fitting portion 18*a* are formed at a front portion and a remaining rear portion, respectively, of an outer peripheral surface of the guide bush 18. The press fitting portion 18*a* is press fitted in an inner peripheral surface of the fitting recess 19, and an annular gap s1 is defined between the non-press fitting portion 18*b* and the inner peripheral surface of the annular recess 19. Moreover, a sliding surface 18*c* annularly bulging within a range of the non-press fitting portion 18*b* is formed on an inner peripheral surface of the guide bush 18.

The movable core 16 is secured to the valve stem 15*b* with a weld bead 21. In addition, the movable core 16 is disposed opposite to the attraction surface 6*a* of the fixed core 6 in such a manner as to form a gap g between the movable core 16 and a front end of the guide bush 18, the gap g corresponding to an opening stroke of the valve element 15.

A sliding member 20 abutting against a rear end surface of the movable core 16 and slidably fitted to the inner peripheral surface of the guide bush 18 is press fitted on the valve stem 15*b*. The sliding member 20 includes a cylindrical shaft portion 20*a* press fitted on the valve stem 15*b*, and a flange portion 20*b* protruding in a radial direction from an outer periphery at a rear end portion of the cylindrical shaft portion 20*a* and configured to be slidably fitted to the sliding surface 18*c* of the guide bush 18. The flange portion 20*b* is provided with a cutout 25 allowing fuel to flow between front and rear sides of the flange portion 20*b*.

A press fitting portion 20*c* and a non-press fitting portion 20*d* having a larger diameter than the press fitting portion 20*c* are formed at a front portion and a remaining rear portion, respectively, of an inner peripheral surface of the cylindrical shaft portion 20*a* of the sliding member 20. The press fitting portion 20*c* is press fitted on an outer peripheral surface of the valve stem 15*b*, and an annular gap s2 is defined between the non-press fitting portion 20*d* and the outer peripheral surface of the valve stem 15*b*. An inner peripheral edge at an upper end of the cylindrical shaft portion 20*a* is connected to the valve stem 15*b* with a weld bead 23.

Thereby, the valve assembly 17 is supported slidably in an axial direction at two points of the valve seat member 3 and the guide bush 18. A distance between the two points is substantially the longest distance of the valve assembly 17, and is effective for stably supporting the valve assembly 17.

The movable core 16 is provided with multiple through holes 22 configured to make the hollow portion 6*b* of the fixed core 6 communicate with an inside of the valve housing 1. A rear end surface of the sliding member 20 around the valve stem 15*b* serves as a spring seat 31. A valve spring 33 configured to bias the sliding member 20 to a valve closing side of the valve element 15 is provided in a compressed state between the spring seat 31 and a pipe-shaped retainer 32 press fitted in the hollow portion 6*b* of the fixed core 6. In this process, a set load of the valve spring 33 is adjusted by a depth to which the retainer 32 is fitted into the fixed core 6.

In FIG. 2 again, a coil assembly 35 is fitted around outer peripheral surfaces ranging from a rear end portion of the magnetic cylindrical body 4 to the fixed core 6. The coil assembly 35 includes a bobbin 36 fitted on the outer peripheral surfaces, and a coil 37 wound therearound. A front end portion of a coil housing 38 configured to house the coil assembly 35 is placed on the yoke portion 4*a* of the magnetic cylindrical body 4 and welded together.

From a rear end portion of the coil housing 38 to a rear end portion of the fixed core 6, a covering layer 40 made of a synthetic resin is formed by molding to cover outer peripheral surfaces of the rear end portions. The covering layer 40 is integrally connected to a coupler 41 protruding at one side of the fixed core 6. The coupler 41 is configured to hold a terminal 42 connected to the coil 37.

Next, the operation of this embodiment will be described.

In a non-energized state of the coil 37, the valve element 15 is pushed frontward by the set load of the valve spring 33, so as to be seated on the valve seat 8, and thereby the fuel discharge holes 10 is closed. That is, in a closed state of the valve element 15, the movable core 16 keeps the predetermined gap g between the movable core 16 and the front end of the guide bush 18 projecting from the attraction surface of the fixed core 6.

When the coil 37 is energized, magnetic flux generated thereby runs through the fixed core 6, the coil housing 38, the magnetic cylindrical body 4, and the movable core 16 in this order. By the magnetic force, the movable core 16 is attracted to the attraction surface 6*a* of the fixed core 6 against the set load of the valve spring 33, and the valve stem 15*b* is lifted. Thereby, the valve part 15*a* is detached from the valve seat 8, so that the valve element 15 is in an open state. In this process, the movable core 16 abuts against the front end of the guide bush 18, which restricts an opening position of the valve element 15.

When the valve element 15 is opened, high pressure fuel fed under pressure to the fuel inlet tube 7 from the fuel distribution pipe D is directly injected to the combustion chamber Ea of the engine from the fuel discharge holes 10 via an interior of the pipe-shaped retainer 32, the hollow portion 6*b* of the fixed core 6, the cutout 25 of the sliding member 20, the through holes 22 of the movable core 16, an interior of the valve housing 1, and the valve seat 8 in this order.

In a process of opening the valve element 15, the valve part 15*a* slides on the inner peripheral surface of the valve seat member 3, and the flange portion 20*b* of the sliding member 20 on the valve stem 15*b* slides on the sliding surface 18*c* of the guide bush 18 in the fixed core 6. Thus, an opening attitude of the valve element 15 is stabilized.

Meanwhile, the annular gaps s1, s2 are provided respectively between the fixed core 6 and the guide bush 18 and between the valve stem 15*b* and the sliding member 20 within a range of the sliding surface 18*c* of the guide bush 18. Hence, when an unbalanced load is applied between the guide bush 18 and the sliding member 20 due to manufacturing errors, an attraction force in an oblique direction frequently generated between the fixed and the movable cores 6, 16, or the like, portions of the guide bush 18 and the sliding member 20 corresponding to the annular gaps s1, s2, respectively, are slightly elastically deformed so that the unbalanced load can be absorbed. This ensures that the guide bush 18 and the sliding member 20 smoothly slide on each other, making it possible to enhance opening and closing response of the valve element 15.

Moreover, in assembling the fuel injection valve I, when the guide bush 18 is press fitted in the inner peripheral surface of the fixed core 6, the press fitting portion 18*a* at the front portion of the guide bush 18 is press fitted, the annular gap s1 is formed between the fixed core 6 and the non-press fitting portion 18*b* at the rear portion of the guide bush 18, and the sliding surface 18*c* exists on the inner periphery of the guide bush 18 corresponding to the annular gap s1. Hence, the sliding surface 18*c* can be prevented from being deformed by a press fitting load of the press fitting portion 18*a* to the fixed core 6.

On the other hand, when the sliding member 20 is press fitted on the outer peripheral surface of the valve stem 15*b*, the press fitting portion 20*c* at the front portion of the sliding member 20 is press fitted, the annular gap s2 is formed between the valve stem 15*b* and the non-press fitting portion 20*d* at the rear portion of the sliding member 20, and a sliding portion, that is, the flange portion 20*b*, of the sliding member 20 corresponding to the annular gap s2 exists. Hence, the flange portion 20*b* can be prevented from being deformed by a press fitting load of the press fitting portion 20*c* to the valve stem 15*b*.

The present invention is not limited to the above-described embodiment, and various design modifications can be made within the scope not departing from the gist thereof. For example, the present invention is applicable also to a case where the fuel injection valve I is attached to an engine intake system.

What is claimed is:

1. An electromagnetic fuel injection valve comprising:

a valve housing having a valve seat at a front end thereof;

a hollow fixed core continuously provided to a rear end of the valve housing;

a movable core disposed opposite to an attraction surface of the fixed core;

a coil disposed on an outer periphery of the fixed core;

a valve element connected to the movable core to cooperate with the valve seat; and a valve spring configured to bias the valve element in a valve closing direction, wherein the movable core is caused to be attracted to the fixed core by energizing the coil so as to open the valve element, a guide bush is press fitted in an inner peripheral surface of the fixed core, the valve element includes:

a valve part configured to cooperate with the valve seat; and a valve stem continuously provided to the valve part and extending toward the guide bush, a sliding member configured to be slidably fitted to an inner peripheral surface of the guide bush is press fitted on the valve stem, wherein an annular gap is provided at least at one of a location between the fixed core and the guide bush and a location between the valve stem and the sliding member, within sliding regions of the guide bush and the sliding member.

2. The electromagnetic fuel injection valve according to claim 1, wherein the annular gap is provided at each of the location between the fixed core and the guide bush and the location between the valve stem and the sliding member, within the sliding regions of the guide bush and the sliding member.

3. The electromagnetic fuel injection valve according to claim 2, wherein an outer peripheral surface of the sliding member is provided with a cutout configured to make a hollow portion of the fixed core communicate with an inside of the valve housing.

* * * * *